US006864792B2

(12) United States Patent
Labit et al.

(10) Patent No.: US 6,864,792 B2
(45) Date of Patent: Mar. 8, 2005

(54) PORTABLE ELECTRONIC SECURITY KEY FOR ELECTRONIC ARTICLE SURVEILLANCE DEVICE

(75) Inventors: Rich Labit, Wellington, FL (US); Steven R. Maitin, Lake Worth, FL (US); Carl A. Brooks, Boca Raton, FL (US); Larry Canipe, Boca Raton, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 4 days.

(21) Appl. No.: 10/236,835

(22) Filed: Sep. 6, 2002

(65) Prior Publication Data

US 2004/0046664 A1 Mar. 11, 2004

(51) Int. Cl.[7] ..... G08B 13/14

(52) U.S. Cl. ..... 340/572.1; 340/572.3; 340/568.1

(58) Field of Search ..... 340/572.1, 572.5, 340/572.7, 573.3, 572.3, 572.4, 572.8, 505, 556, 442; 283/67, 70, 81; 235/378, 383, 385

(56) References Cited

U.S. PATENT DOCUMENTS

| | | | | |
|---|---|---|---|---|
| 4,510,489 A | | 4/1985 | Anderson et al. | 340/572.1 |
| 4,546,436 A | | 10/1985 | Schneider et al. | 600/361 |
| 5,353,011 A | * | 10/1994 | Wheeler et al. | 340/572.4 |
| 5,433,096 A | * | 7/1995 | Janssen et al. | 70/278.3 |
| 5,537,126 A | * | 7/1996 | Kayser et al. | 345/2.1 |
| 5,583,819 A | | 12/1996 | Roesner et al. | 340/10.51 |
| 5,675,490 A | * | 10/1997 | Bachhuber | 701/32 |
| 5,778,882 A | | 7/1998 | Raymond et al. | 600/513 |
| 6,025,780 A | | 2/2000 | Bowers et al. | 340/572.3 |
| 6,360,208 B1 | * | 3/2002 | Ohanian et al. | 705/31 |
| 6,630,885 B2 | * | 10/2003 | Hardman et al. | 340/505 |
| 6,700,489 B1 | | 3/2004 | Easter et al. | 340/572.3 |

FOREIGN PATENT DOCUMENTS

WO WO 91/15645 * 10/1991

* cited by examiner

*Primary Examiner*—Van T. Trieu

(57) ABSTRACT

An electronic key capable of reinitializing or resetting a security disabled electronic article surveillance (EAS) device is provided. The electronic key can be a secure, portable, and battery powered for initializing a secured EAS system's security protocol to factory default state, or to another preselected state. The key has its own set of security protocols to prevent unauthorized use and can easily be reprogrammed for a wide variety of other functions including, but not limited to, firmware upgrading, diagnostic testing, and the like. The key can be connected to the programming port of an EAS device and perform a preset reprogramming operation, resetting activated security features. The key could be purchased for customer use, and would be secured by preselecting the total number of uses, such as one use. The one-time use would begin once the key is activated. Activation of the key is also uniquely controlled to prevent its misuse. In one embodiment, the electronic key must detect the interrogation field of a properly functioning EAS exit system prior to becoming enabled. The allowed usage can be limited by time, the number of units reprogrammed, or a combination of both. Once the key has been activated for its pre-selected number of uses and shuts off, only qualified service personnel can reset the electronic key function for further uses.

16 Claims, 3 Drawing Sheets

PORTABLE ELECTRONIC SECURITY KEY FOR ELECTRONIC ARTICLE SURVEILLANCE DEVICE

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates to electronic article surveillance (EAS) and more particularly to a portable apparatus that resets the security features of an EAS device to a preselected configuration.

2. Description of the Related Art

EAS systems are well known for the prevention or deterrence of unauthorized removal of articles from a controlled area. In a typical EAS system, tags designed to interact with an electromagnetic field located at the exits of the controlled area are attached to articles to be protected. If a tag is brought into the electromagnetic field or "interrogation zone", the presence of the tag is detected and appropriate action is taken. For a controlled area such as retail store, the appropriate action taken for detection of an EAS tag may be the generation of an alarm. Some types of EAS tags remain attached to the articles to be protected, but are deactivated prior to authorized removal from the controlled area by a deactivation device that changes a characteristic of the tag so that the tag will no longer be detectable in the interrogation zone. U.S. Pat. No. 4,510,489 illustrates one such EAS system.

The majority of EAS tag deactivation devices are fixed at a specific location, such as adjacent a point-of-sale (POS) station in a retail environment. If an article is purchased, and for whatever reason the attached EAS tag is not deactivated at the deactivator adjacent the POS station, the EAS tag will set off an alarm at the store exit. To then deactivate the EAS tag, the article must be brought back to the deactivator adjacent the POS station, which causes confusion and customer embarrassment. Handheld deactivators for RF type EAS tags, which are part of a handheld bar-code scanner, are known, but still require the EAS tag to be brought near the POS station, within range of the handheld scanner/deactivator cord, for deactivation.

In U.S. patent application Ser. No. 09/723,641, filed Nov. 27, 2000, a cordless, handheld deactivator that deactivates EAS tags when they are away from or "remote" from the hardwired deactivator near the POS station is disclosed. Operation of that device, and many other devices, require storing a security code, or personal identification code, into the device that must be input to activate the device, much like a password permits access to a computer. Upon initial use of the device, a security code is selected by the user and must be input before the device can be activated. If the selected security code is forgotten, the device cannot be activated. A service call must be made to reinitialize or reset the device to the initial factory configuration. Once the device is initialized, the user can select a new security code for operation. An apparatus is needed that provides a secure method to enable a user to reinitialize the device so that a new security code can be stored therein. Presently, re-initialization requires a service call for security reasons. Otherwise, a stolen portable deactivator, or similar device, could be reinitialized and used by a thief, even though the thief does not know the security code that was initially used to activate the device.

Certain devices may have other user-defined settings, which would be lost upon reinitializing the device. A reinitializing apparatus could be used to read and temporarily store the user-defined settings and restore the device to those settings upon reinitialization. Thus, a technician performing service call to work on such a device will be able to reset the device to user-specified settings rather than to default factory settings after servicing the device.

BRIEF SUMMARY OF THE INVENTION

A portable and programmable security reinitialization method and apparatus for electronic article surveillance devices, includes a processor; and a method of communication with an electronic article surveillance device to be reinitialized connected to the processor. A button or other mechanism connected to the processor for activating a security code reinitialization in the device to be reinitialized wherein a security code stored in the device is set to a preselected value. The processor is preferably battery powered and includes a sleep mode and an active mode, where the sleep mode uses less power than the active mode for reducing battery consumption. Including either a reset or timeout for putting the processor into the sleep mode. A push-button or other method can be used for putting the processor into the active mode and for activating the security code reinitialization.

The apparatus can further include a receiver for sending a signal to the processor after receipt of a valid EAS transmit signal at a preselected frequency and threshold, the processor activating the security code reinitialization only after receipt of the valid EAS transmit signal. The apparatus can include an interface for programming the processor. The communication can be via RS-232 protocol. The apparatus can include video and/or audio feedback to a user. A real-time clock can be used with a software-controlled oscillator for driving audio feedback.

Objectives, advantages, and applications of the present invention will be made apparent by the following detailed description of embodiments of the invention.

DETAILED DESCRIPTION OF THE INVENTION

The present invention is an electronic key capable of reinitializing or resetting a security disabled EAS device. The key can be connected to the programming port of an EAS device and perform a preset reprogramming operation, resetting activated security features. The key could be purchased for customer use, and would be secured by preselecting the total number of uses, such as one use. The one-time use would begin once the key is activated. Activation of the key is also uniquely controlled to prevent its misuse. In one embodiment, the electronic key must detect the interrogation field of a properly functioning EAS exit system prior to becoming enabled. The allowed usage can be limited by time, the number of units reprogrammed, or a combination of both. Once the key has been activated for its pre-selected number of uses and shuts off, only qualified service personnel can reset the electronic key function for further uses.

The electronic key can be a secure, portable, and battery powered for initializing a secured EAS system's security protocol to factory default state, or to another preselected state. The key has its own set of security protocols to prevent unauthorized use and can easily be reprogrammed for a wide variety of other functions including, but not limited to, firmware upgrading, diagnostic testing, and the like.

Figure 1:
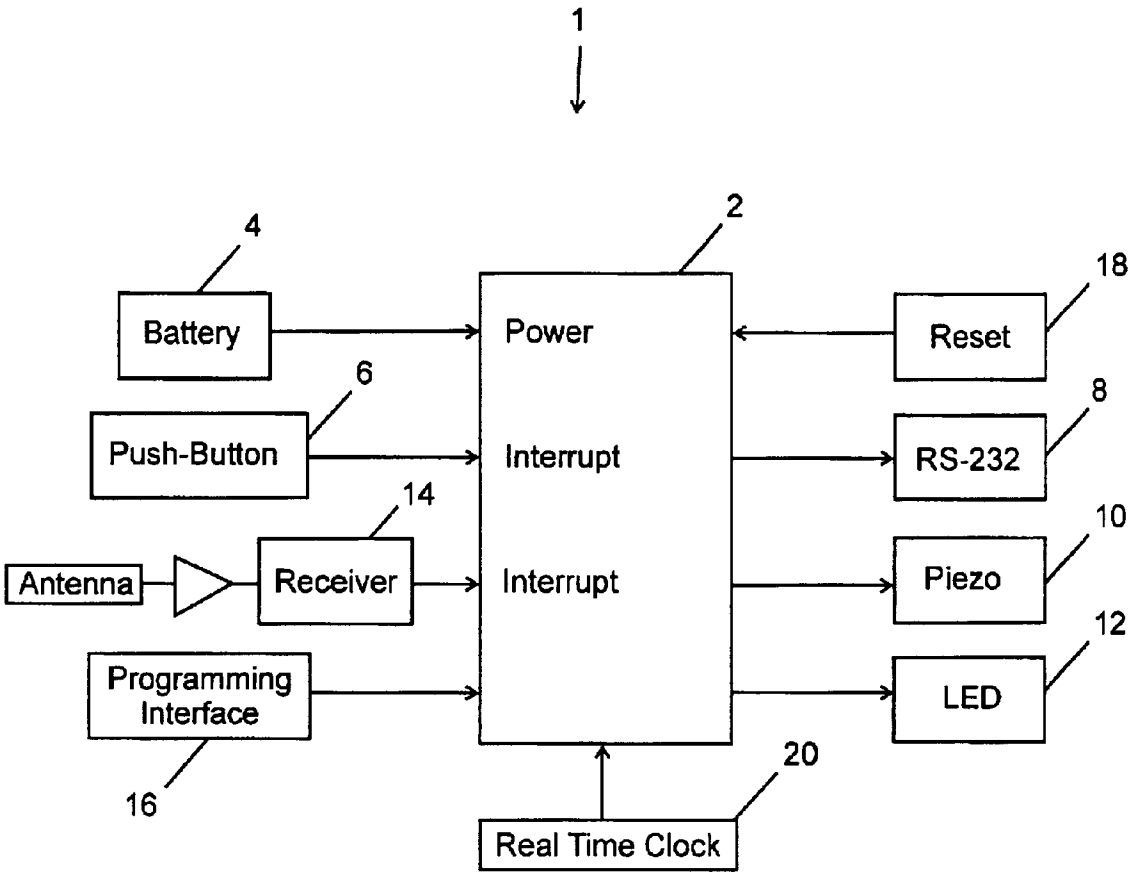
FIG. 1 is a block diagram of one embodiment of the present invention.

Referring to FIG. 1, one embodiment for the portable security key 1 is illustrated and includes processor 2, which can be a microcontroller. Processor 2 can be powered by battery 4, and receives interrupts from push-button 6. Push-button 6 activates processor 2 from sleep mode, and enables the RS-232 circuitry 8. The RS-232 circuitry 8 is the primary serial communication protocol between the key 1 and the EAS device to which it is attached for reinitializing. The signal levels are normalized, shifted up and down as required, both into and out of the processor 2, for proper RS-232 serial communication and operation of the processor 2. After the RS-232 circuitry 8 is enabled, the key 1 is enabled and resetting of the EAS system to default settings can begin. The push-button 6 also requests an indication of the number of key 1 uses that are available. This information can be indicated on piezo 10, which provides audio feedback to the user, and/or LED 12, which provides visual feedback to the user. Piezo 10 can be any device that provides an audio indication, and LED 12 can be any device that provides a visual indication.

Processor 2 can be configured to prevent operation of key 1 until an interrupt is received from EAS system receiver 14. If enabled, receiver 14 provides passive signal sampling for an EAS interrogation field. If transmit bursts are received from an EAS system transmit antenna at a predetermined frequency and threshold, receiver 14 sends an interrupt to processor 2 indicating that a valid EAS system detection has occurred. This feature will prevent the key from being used in an unauthorized area to reinitialize a portable EAS tag deactivator, for example.

Programming interface 16 is a serial interface that permits reprogramming of processor 2. Updates and configuration/operational changes are easily performed on key 1 through interface 16. Reset 18 returns processor 2 to the sleep mode, which conserves battery life. Processor 2 may be configured to return to the sleep mode automatically after a preselected time period without activity. Real-time clock 20 provides counter/timer functions for processor 2 and can provide a software-controlled oscillator to drive the audio indicator, piezo 10.

The processor 2, which can be a microcontroller, is programmed to be responsible for analyzing all signal inputs. When all required conditions have been met, the processor 2 initiates communication with the desired EAS equipment via the RS-232 port 8 and performs the security code reset function. Processor 2 will then qualify whether or not its programmed life cycle has expired. If the preselected number of resets has expired, the processor 2 renders the electronic key 1 inoperable. The user cannot reset this shutdown mode, even if power to key 1 is cycled, and requires the key 1 to be reset/reinitialized by authorized personnel.

Figure 2:
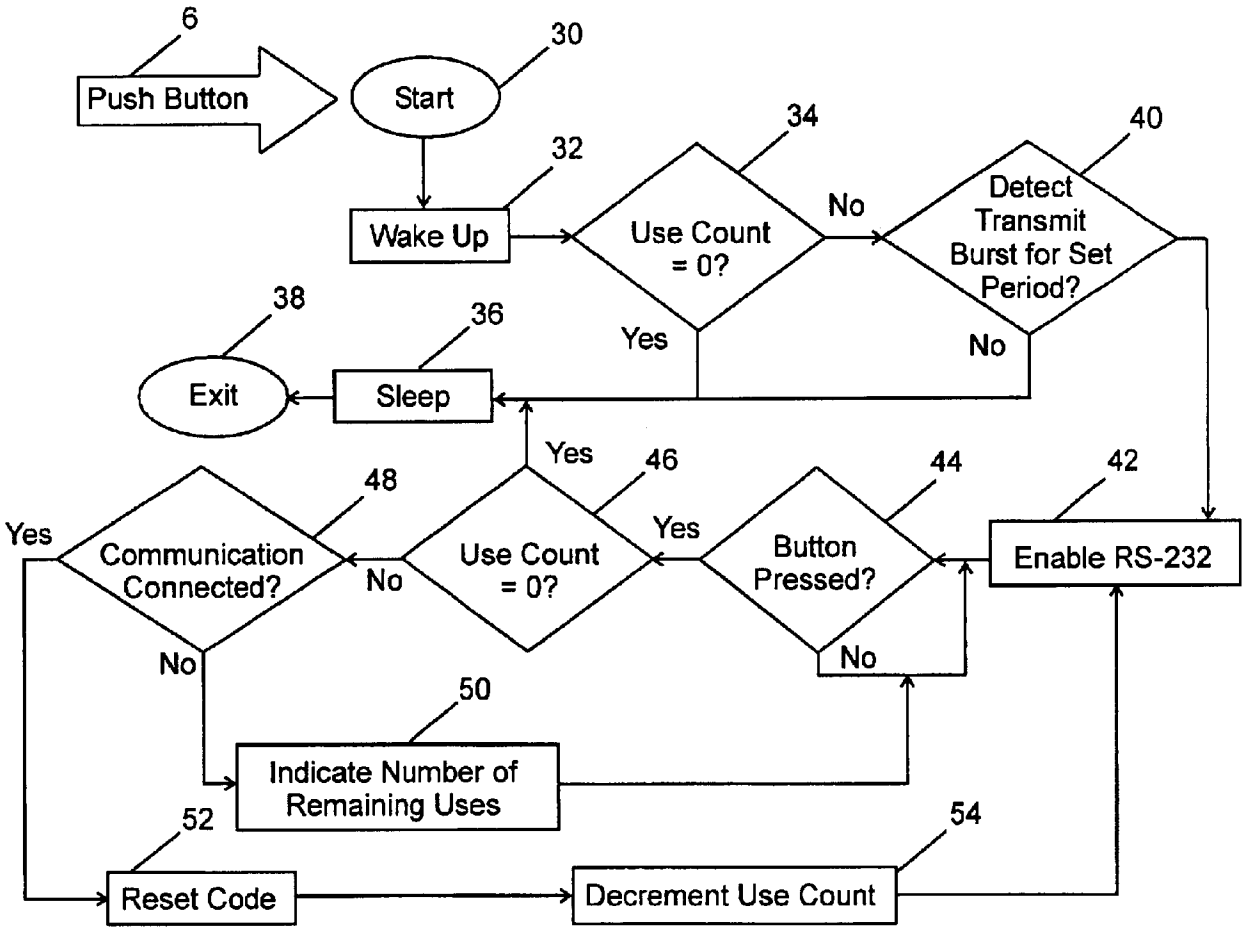
FIG. 2 is a flow diagram of one embodiment of the present invention.

Referring to FIG. 2, one configuration for processor 2 is illustrated. Push-button 6 starts the process at 30 and "wakes up" processor 2 from the sleep mode at 32. Processor 2 checks the status of the programmed number of allowed resets at 34. If the number of resets has been expended, the processor 2 is set to the sleep mode at 36 and the program is exited at 38. If the number of resets has not been expended at 34, the processor 2 waits for an interrupt at 40, indicating that a valid EAS transmit interrogation signal has been received by receiver 14. If no interrupt is received at 40 in a preselected period of time, processor 2 is put into the sleep mode at 36. If an interrupt is received at 40, processor 2 enables RS-232 communication at 42. If push-button 6 is depressed at 44, the use counter is checked to make sure there is another use available at 46, if not processor 2 is set to the sleep mode at 36, otherwise, processor 2 verifies that a valid RS-232communication is established with a device to be rest at 48. If valid communication is not established at 48, an indication of how many resets are available is displayed at 50, and processor 2 loops back to 44 to check the status of push-button 6. If valid communication is established at 48, processor 2 initiates a reset/reinitialization of the attached device at 52. The programmed number of resets is then decremented by 1 at 54, and processor 2 loops back to enable RS-232 communication at 42.

Figure 3:
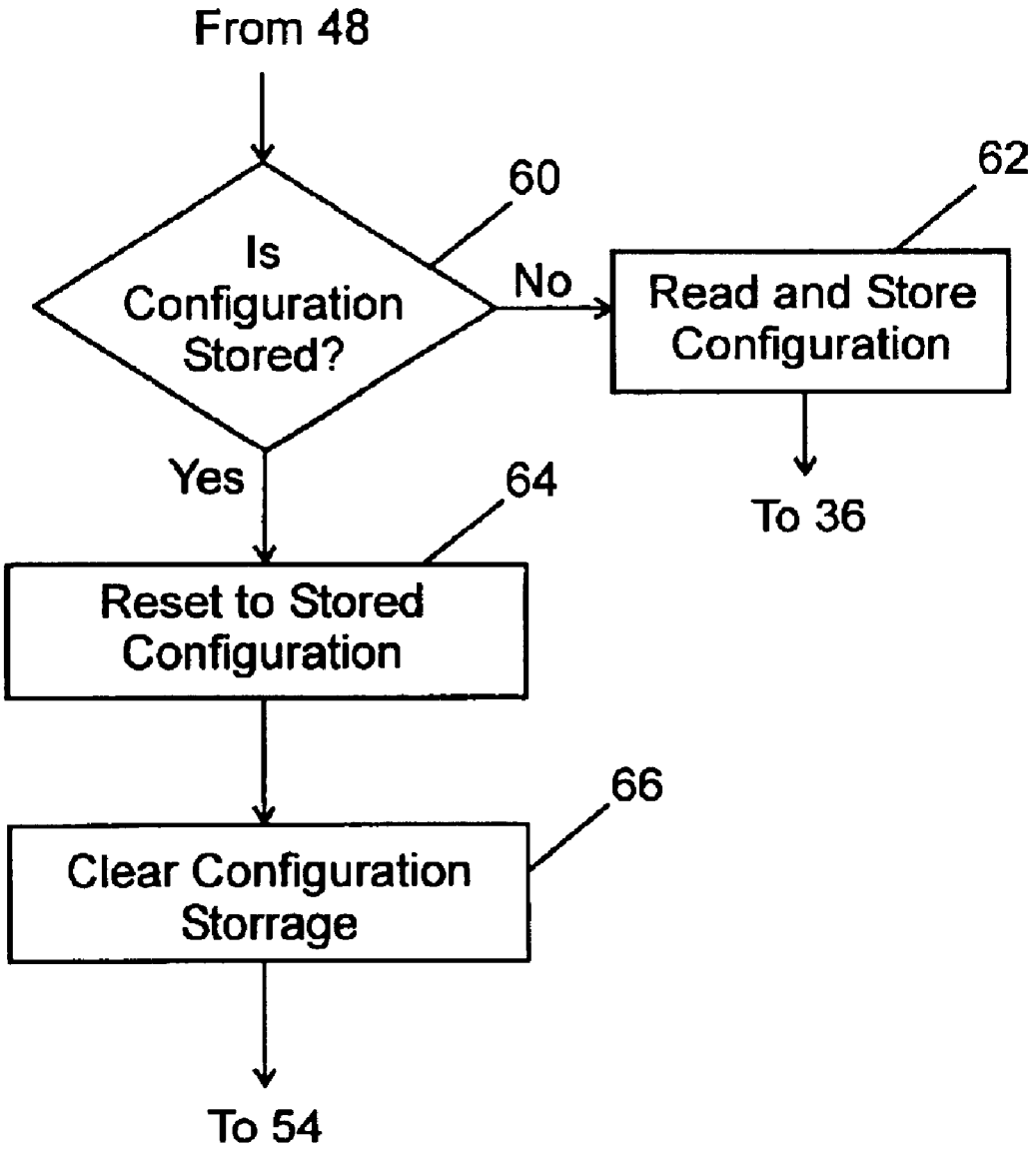
FIG. 3 is a partial flow diagram illustrating an alternate embodiment of the present invention.

Referring to FIG. 3, in an alternate embodiment, key 1 can be configured to read and store a preselected security code of a device, and then be used to restore the device to the preselected configuration. For this implementation the illustration shown in FIG. 3 replaces step 52 shown in FIG. 2. FIG. 3 illustrates the functions changed for the alternate embodiment, all other functions are identical as shown and described for FIG. 2 above. In the alternate embodiment, once valid communication is verified at 48, processor 2 checks to see if a configuration has been previously stored at 60. If not, a configuration is read and stored at 62 and processor 2 is put to sleep at 36. If a configuration is stored at 60, the device is reset to the stored values at 64, the configuration storage register is cleared at 66, and the use counter is decremented by 1 at 54. All other functions of the alternate embodiment are as previously described per FIG. 2, expect step 52, which has been replaced by steps 60–66 as illustrated in FIG. 3.

As illustrated for the alternate embodiment, security key 1 can be configured in further embodiments for any number of specific applications and is not limited to the examples demonstrated herein.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the forgoing disclosure.

What is claimed is:

1. A portable apparatus for reinitialization of an electronic article surveillance device for use in affecting an electronic article surveillance device proximate said article, said apparatus comprising:

a processor;

means, connected to said processor, for communication with said electronic article surveillance device to be reinitialized; and, means, connected to said processor, for activating a security code reinitialization in said device to be reinitialized wherein a security code stored in said device is set to a preselected value.

2. The apparatus of claim 1 wherein said processor is battery powered and includes a sleep mode and an active mode, said sleep mode using less power than said active mode for reducing battery consumption.

3. The apparatus of claim 2 further comprising means for putting said processor into said sleep mode.

4. The apparatus of claim 3 further comprising means for putting said processor into said active mode and for generating an interrupt to said processor for activating said security code reinitialization.

5. The apparatus of claim 4 further comprising receiver means for sending a second a second interrupt to said processor after receipt of an electronic article surveillance transmit signal at a preselected frequency and threshold, said processor activating said security code reinitialization only after receipt of said second interrupt.

6. The apparatus of claim 5 further comprising means for programming said processor.

7. The apparatus of claim 1 wherein said means for communication includes an RS-232 protocol.

8. The apparatus of claim 1 further comprising means for video feedback to a user.

9. The apparatus of claim 1 further comprising means for audio feedback to a user.

10. The apparatus of claim 9 further including a real-time clock and a software-controlled oscillator for driving said means for audio feedback.

11. A method for reinitialization, to preselected settings, of a security code of an electronic article surveillance device for use in affecting an electronic article surveillance device proximate said article, said method comprising:

activating a reinitialization procedure;

checking if a preselected number of resets allowed has been expended, and if so then stopping, otherwise;

enabling communication with the electronic article surveillance device to be reinitialized;

checking for an indication to proceed with reinitializing;

checking if the number of resets allowed has been expended, and if so then stopping, otherwise;

checking if the electronic article surveillance device is connected, and if so then, reinitializing the security code of the electronic article surveillance device to preselected values;

decrementing the number of resets allowed by one; and, jumping to the enabling communication step and repeating the subsequent steps.

12. The method of claim 11 wherein said activating a reinitialization procedure includes waking a processor form a sleep mode and wherein said step of stopping includes putting said processor into said sleep mode.

13. The method of claim 12 further comprising in the step of checking if the electronic article surveillance device is connected, if the electronic article surveillance device is not connected, then indicating to the user the remaining number of resets allowed.

14. The method of claim 13 wherein the step of reinitializing the security code of the electronic article surveillance device to preselected values further comprises:

checking for a stored security code configuration of the electronic article surveillance device, and if none is found then, reading and storing the security code of the electronic article surveillance device and stopping;

otherwise, if a security code configuration of the electronic article surveillance device is stored, then;

resetting said security code of the electronic article surveillance device to said stored security code configuration and clearing said stored security code configuration.

15. A portable and programmable security reinitialization apparatus for electronic article surveillance devices, comprising:

a processor, wherein said processor is battery powered and includes a sleep mode and an active mode, said sleep mode using less power than said active mode for reducing battery consumption;

means for putting said processor into said sleep mode;

means, connected to said processor, for communication with an electronic article surveillance device to be reinitialized; and, means, connected to said processor, for activating a security code reinitialization in said device to be reinitialized wherein a security code stored in said device is set to a preselected value;

means for putting said processor into said active mode and for generating an interrupt to said processor for activating said security code reinitialization; and receiver means for sending a second interrupt to said processor after receipt of an electronic article surveillance transmit signal at a preselected frequency and threshold, said processor activating said security code reinitialization only after receipt of said second interrupt.

16. The apparatus of claim 15, further comprising means for programming said processor.

* * * * *